US007624974B2

(12) United States Patent
Zheng

(10) Patent No.: US 7,624,974 B2
(45) Date of Patent: Dec. 1, 2009

(54) RELEASE MECHANISM OF BAR CLAMP

(76) Inventor: Bo Ren Zheng, 6F., No. 86, Sec. 2, Liming Rd., Nantun District, Taichung City (TW)

( * ) Notice: Subject to any disclaimer, the term of this patent is extended or adjusted under 35 U.S.C. 154(b) by 387 days.

(21) Appl. No.: 11/546,855

(22) Filed: Oct. 11, 2006

(65) Prior Publication Data

US 2008/0088071 A1 Apr. 17, 2008

(51) Int. Cl.
*B25B 1/00* (2006.01)

(52) U.S. Cl. ..... 269/6; 269/3

(58) Field of Classification Search ..... 269/3, 269/6, 143, 166–171.5; 254/106–107; 222/325–327, 222/391; 81/487
See application file for complete search history.

(56) References Cited

U.S. PATENT DOCUMENTS 6,338,475 B1 * 1/2002 Ping ..... 269/6
6,382,608 B1 * 5/2002 Michell ..... 269/6
6,578,837 B1 * 6/2003 Blank et al. ..... 269/6
6,655,670 B1 * 12/2003 Liou ..... 269/6
7,017,894 B1 * 3/2006 Lin ..... 269/6
7,172,183 B1 * 2/2007 Yang ..... 269/6
7,513,492 B1 * 4/2009 Kuo ..... 269/6
2006/0226588 A1 * 10/2006 Khachatoorian et al. ..... 269/6
2008/0088071 A1 * 4/2008 Zheng ..... 269/6

* cited by examiner

*Primary Examiner*—Lee D Wilson
(74) *Attorney, Agent, or Firm*—Pro-Techter Int'l Services; Ralph Willgohs

(57) ABSTRACT

A bar clamp includes a driving key including a first key plate, an intermediate second key plate engaged the first key plate, and a rear first spring engaged with the first and second key plates; a locking key including a third key plate, an intermediate fourth key plate engaged with the third key plate, and a rear second spring engaged with the third and fourth key plates; and a spring-biased release button engaged with a protrusion of the third key plate. Pressing the release button against a handle grip will counterclockwise pivot the protrusion to compress the second spring until the third key plate contacts the fourth key plate and the third key plate is disposed perpendicularly to a longitudinal axis of a slide bar. Further pressing the release button will counterclockwise pivot the third and fourth key plates until they are perpendicular to the axis of the slide bar.

10 Claims, 8 Drawing Sheets

RELEASE MECHANISM OF BAR CLAMP

BACKGROUND OF THE INVENTION

1. Field of Invention

The invention relates to bar clamps and more particularly to such a bar clamp having an improved release mechanism which is adapted to smoothly release the clamping action of the bar clamp by two continuous steps.

2. Related Art

A main portion of a conventional bar clamp is shown in FIG. 1. The bar clamp comprises a driving key 10 including a forward first key plate 11, an intermediate second key plate 12, a plastic first pad 13 sandwiched between the first key plate 11 and the second key plate 12, and a rear first spring 16 urged against the intermediate second key plate 12, and a trigger handle 15 having an inner end pivotably secured within a housing of the bar clamp and engaged with a front surface of the forward first key plate 11.

The bar clamp further a locking key 20 spaced from a rear of the first spring 16. The locking key 20 comprises a forward third key plate 21, an intermediate fourth key plate 22, a plastic second pad 23 sandwiched between the third key plate 21 and the fourth key plate 22, and a rear second spring 24 urged against the intermediate fourth key plate 22, and a release handle 25 having an inner end pivotably secured within the housing of the bar clamp and engaged with a front surface of the forward third key plate 21. The release handle 25 is substantially parallel with the trigger handle 15 and is projected out of the front of a handle grip of the bar clamp. A slide bar 14 is disposed through the second spring 24, a slot 221 of the intermediate fourth key plate 22, a slot of the second pad 23, a slot 211 of the forward third key plate 21, a slot of the release handle 25, the first spring 16, a slot 121 of the intermediate second key plate 12, a slot of the first pad 13, a slot 111 of the forward first key plate 11, and a slot of the trigger handle 15 to terminate at a movable jaw carrier.

In a standby position, the driving key 10 is oriented perpendicularly relative to a longitudinal axis of the slide bar 14, and the locking key 20 is slightly inclined relative to the longitudinal axis of the slide bar 14. Thereafter, a user may repeatedly squeeze the trigger handle 15 toward the handle grip by holding with one hand to move a movable jaw toward a fixed jaw by incrementally advancing the slide bar 14. The clamping action can be stopped when a work piece is tightly secured by the jaws. To the contrary, activation of the release handle 25 in opposition to the second spring 24 tilts the locking key 20 into a position perpendicular to the longitudinal axis of the slide bar 14. Next, the slide bar 14 can travel freely to release the interference fit between the locking key 20 and the slide bar 14 so as to allow the movable jaw to move away from the fixed jaw. As an end, the work piece is released.

However, the conventional the bar clamp suffered from a couple of disadvantages. For example, the slots 111, 121, 211, and 221 are subject to wear after a period time of use. As a result, the desired locking force exerted by the locking key 20 is reduced greatly. It is typical that a user has to exert a substantial force in the clamping action after a period time of use. This is not desirable. A precise machining of the slots 111, 121, 211, and 221 can overcome the above drawback.

But its cost is very high. In addition, the pads 13 and 23 can hinder the locking or driving action of the slide bar 14 after a period time of use as experienced by many users. Thus, the need for improvement still exists.

SUMMARY OF THE INVENTION

It is therefore an object of the invention to provide a bar clamp having a release mechanism adapted to smoothly release a clamping action of the bar clamp by two continuous steps.

To achieve the above and other objects, the invention provides a bar clamp comprising a housing including a front portion and a rear portion; a movable jaw carrier having a movable jaw; a fixed jaw carrier extended upward forward from the housing and having a fixed jaw aligned with the movable jaw; a driving key disposed in the front portion of the housing and including a forward first key plate including a first slot and a lower first projection projected from a rear surface, an intermediate second key plate engaged with the first projection and including a second slot and an upper first passageway, and a rear first spring having a forward end inserted through the first passageway to engage with the rear surface of the first key plate and a remaining portion urged against the rear surface of the second key plate; a trigger handle having an inner end section engaged with a front surface of the first key plate; a locking key disposed in the rear portion of the housing and including a forward third key plate including a third slot, a protrusion extended downward from a bottom, and an upper second projection projected from a rear surface, an intermediate fourth key plate engaged with the second projection and including a fourth slot and a lower second passageway, and a rear second spring having a forward end inserted through the second passageway to engage with the rear surface of the third key plate and a remaining portion urged against the rear surface of the fourth key plate; a handle grip extended downward from a bottom of the housing; a spring-biased release button projected from a front surface of the handle grip and engaged with a lower portion of the protrusion; and a longitudinal slide bar disposed through the second spring, the fourth and third slots, the first spring, the second and first slots, and the movable jaw carrier, wherein in a standby position, the first and second key plates are oriented substantially perpendicularly to a longitudinal axis of the slide bar, and the third and fourth key plates are substantially inclined relative to the longitudinal axis of the slide bar; whereby squeezing the trigger handle toward the handle grip will counterclockwise pivot the first and second key plates in opposition of the first spring to dispose the first and second key plates at an inclined angle relative to the longitudinal axis of the slide bar with the movable jaw moved toward the fixed jaw by a predetermined distance; whereby releasing of the trigger handle will return the trigger handle and the driving key to the standby position; whereby pressing the release button against the handle grip will counterclockwise pivot the protrusion to compress the second spring until the third key plate contacts the fourth key plate and the third key plate is disposed perpendicularly to the longitudinal axis of the slide bar; and whereby further pressing the release button will counterclockwise pivot both the third and fourth key plates until the third and fourth key plates are disposed perpendicularly to the longitudinal axis of the slide bar.

In one aspect of the invention the first passageway is either a recess or a through hole.

In another aspect of the invention the second passageway is either a recess or a through hole.

The above and other objects, features and advantages of the invention will become apparent from the following detailed description taken with the accompanying drawings.

DETAILED DESCRIPTION OF THE INVENTION

Figure 1:
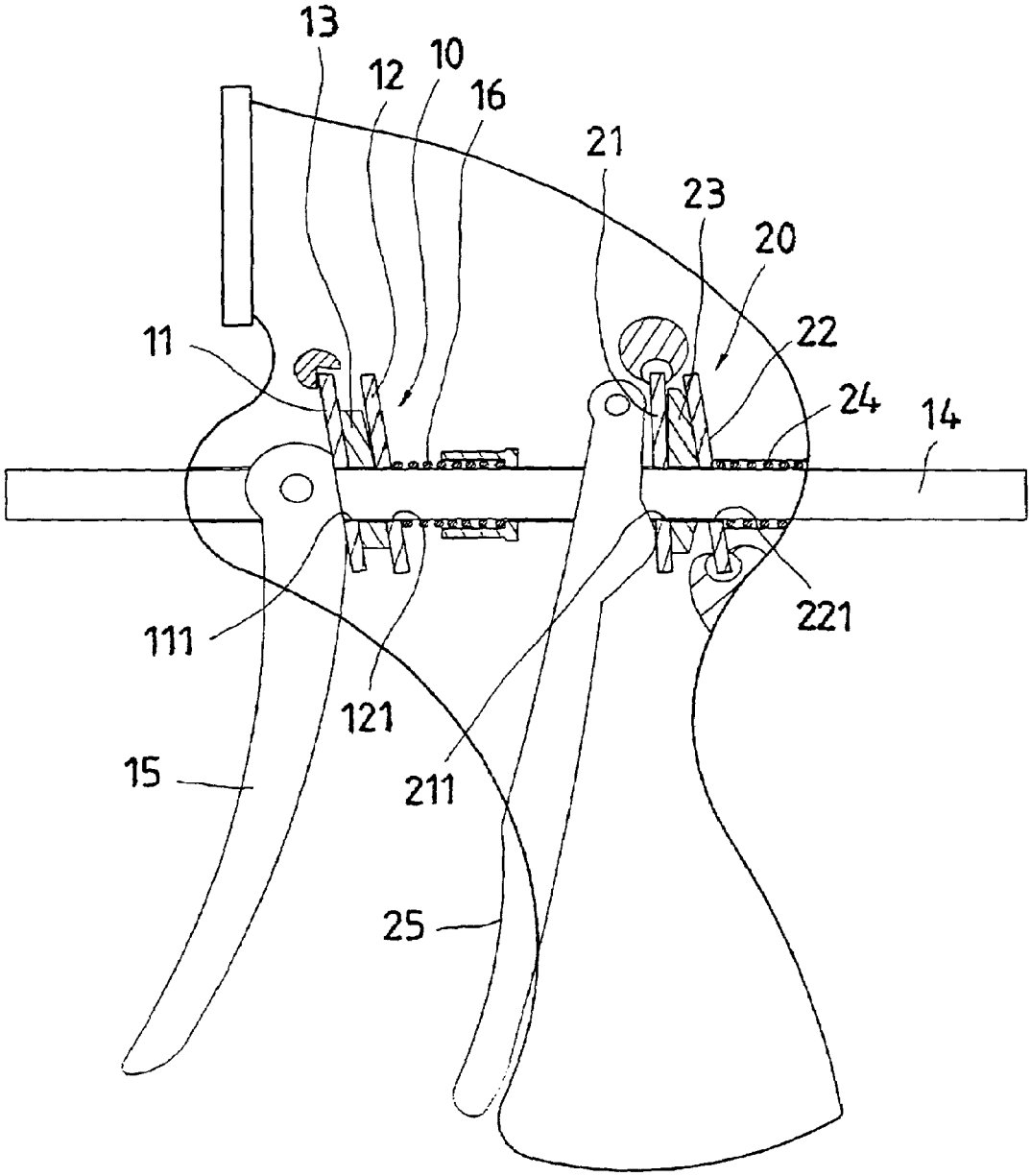
FIG.1 PRIOR ART
FIG. 1 is a side elevation in part section of the main portion of a conventional bar clamp.
Figure 2:
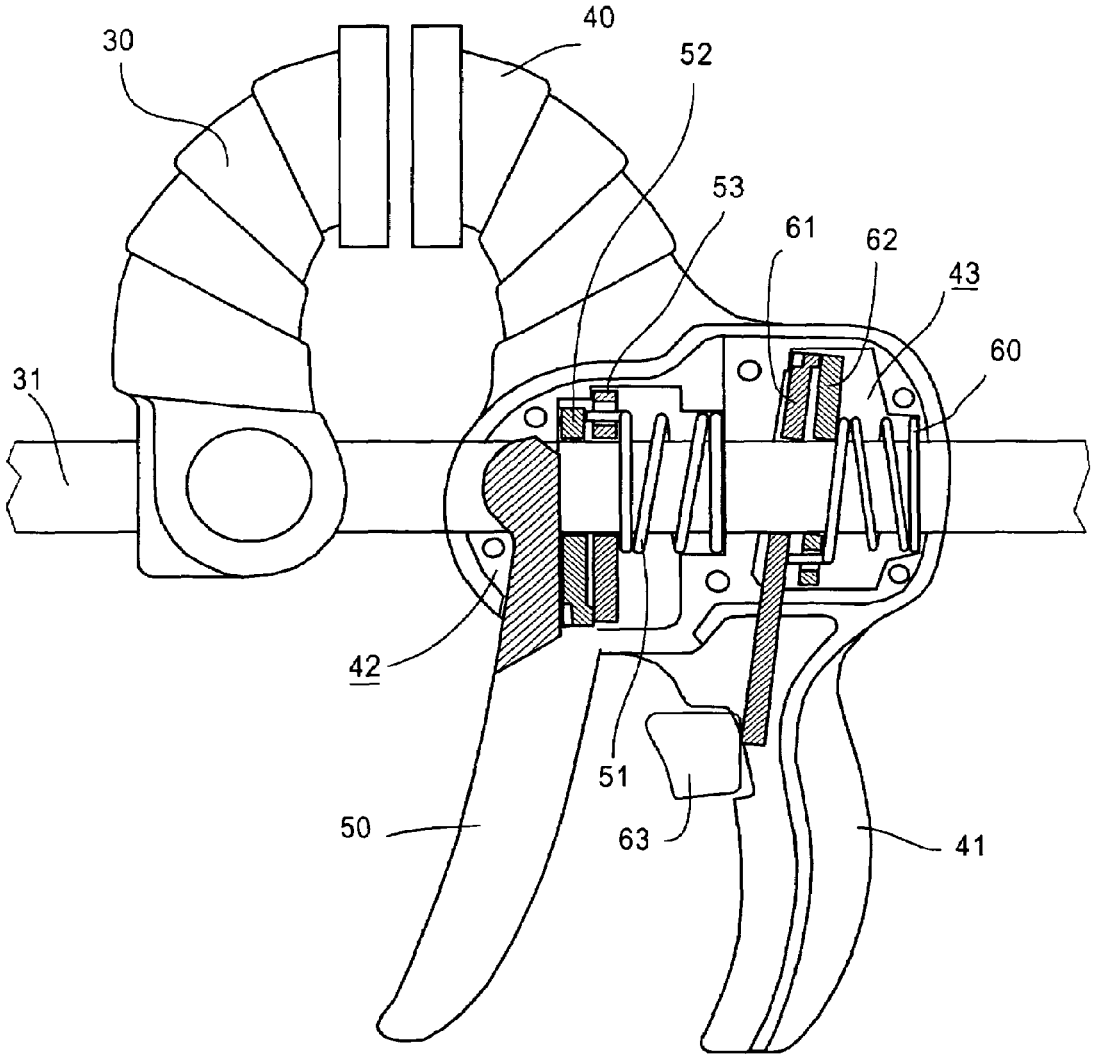
FIG. 2 is a side elevation in part section of a bar clamp according to the invention.
Figure 3:
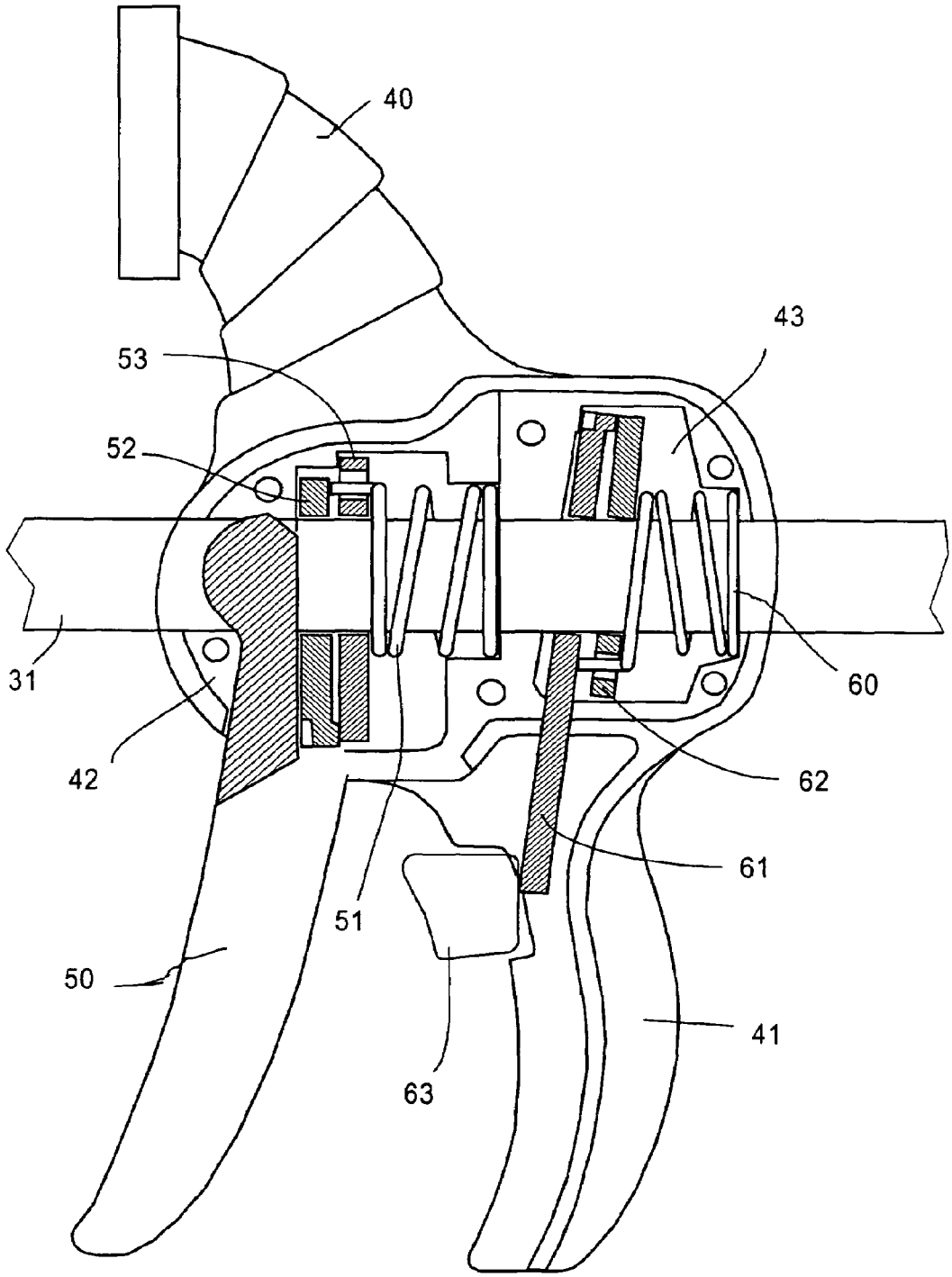
FIG. 3 is an enlarged view of the main portion of the bar clamp in FIG. 2.
Figure 4:
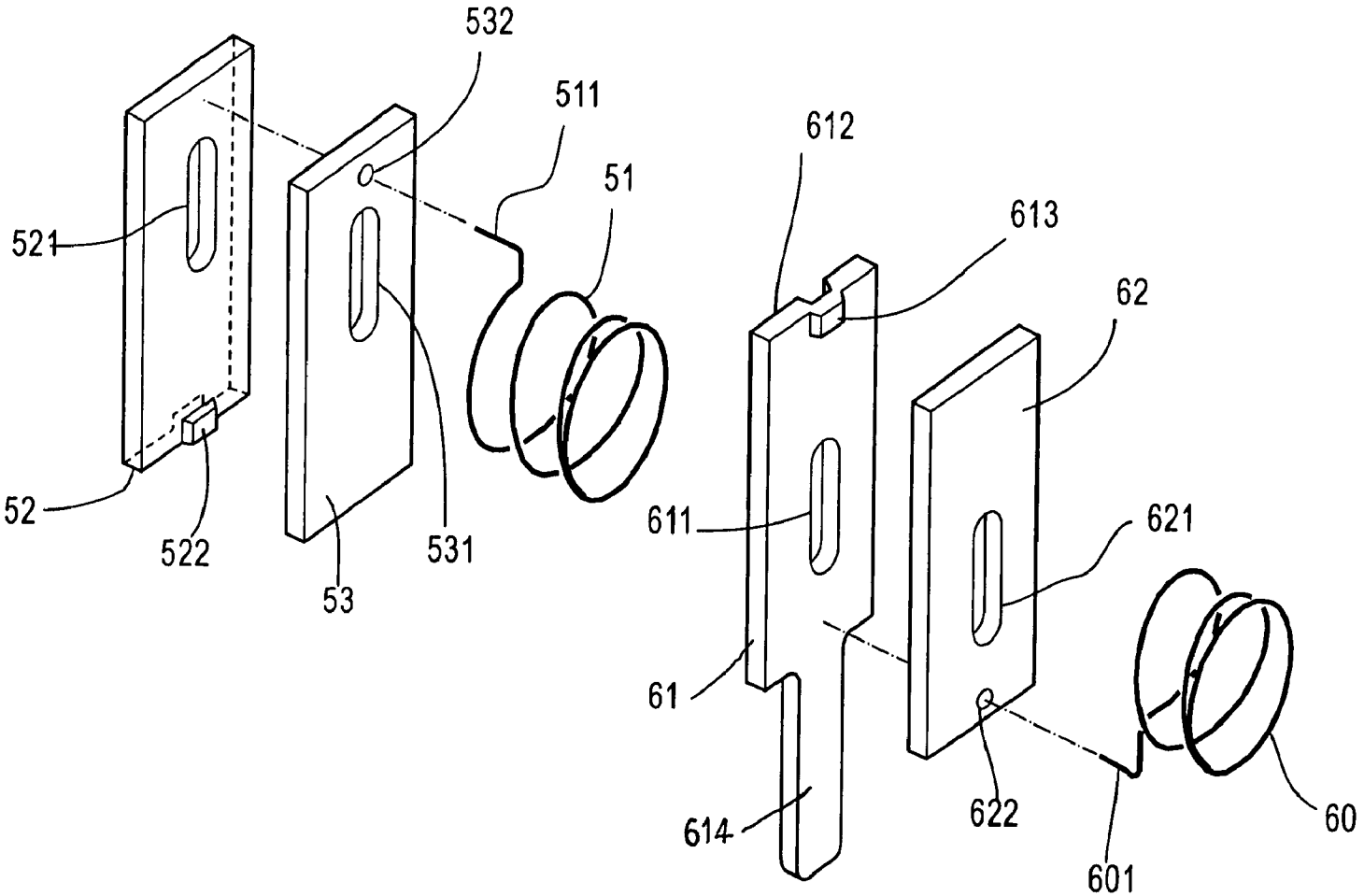
FIG. 4 is an exploded view of a first preferred embodiment of the first key plate, the second key plate, the third key plate, and the fourth key plate according to the invention.

Referring to FIGS. 2, 3, and 4, a bar clamp in accordance with the invention comprises a driving key including a forward rectangular first key plate 52 including a slot 521 and a lower pivot projection 522 projected from its rear surface; an intermediate rectangular second key plate 53 having a front surface engaged with the pivot projection 522 and including a slot 531 and an upper through hole 532; and a rear first elastic member, which in one embodiment is a spring 51 having a forward end 511 inserted through the hole 532 to engage with the rear surface of the first key plate 52, the first spring 51 urged against the rear surface of the second key plate 53. The first key plate 52, the second key plate 53, and the first spring 51 are anchored in a forward housing 42.

The driving key further comprises a trigger handle 50 having an inner end pivotably secured within the forward housing 42 and engaged with a front surface of the first key plate 52.

The bar clamp further has a locking key including a forward third key plate 61 including a slot 611, a protrusion 614 extended downward from its bottom, a forward surface 612, and an upper pivot projection 613 projected from its rear surface; an intermediate rectangular fourth key plate 62 having a front surface engaged with the pivot projection 613 and including a slot 621 and a lower through hole 622; and a rear second elastic member, which in one embodiment is a spring 60 having a forward end 601 inserted through the hole 622 to engage with the rear surface of the third key plate 61, the second spring 60 urged against the rear surface of the fourth key plate 62. The third key plate 61, the fourth key plate 62, and the second spring 60 are anchored in a rear housing 43.

The locking key further comprises a release button 63, which in one embodiment is a spring-biased release button, projected from a front surface of a handle grip 41 and engaged with a lower portion of the protrusion 614.

The bar clamp further a longitudinal slide bar 31 disposed through the second spring 60, the slots 621 and 611, the first spring 51, the slots 531 and 521, and a movable jaw carrier 30 prior to terminating in front of the movable jaw carrier 30. The bar clamp further comprises a fixed jaw carrier 40 extended upward forward from the housing. The fixed jaw carrier 40 has a fixed jaw aligned with a movable jaw of the movable jaw carrier 30.

Figure 5:
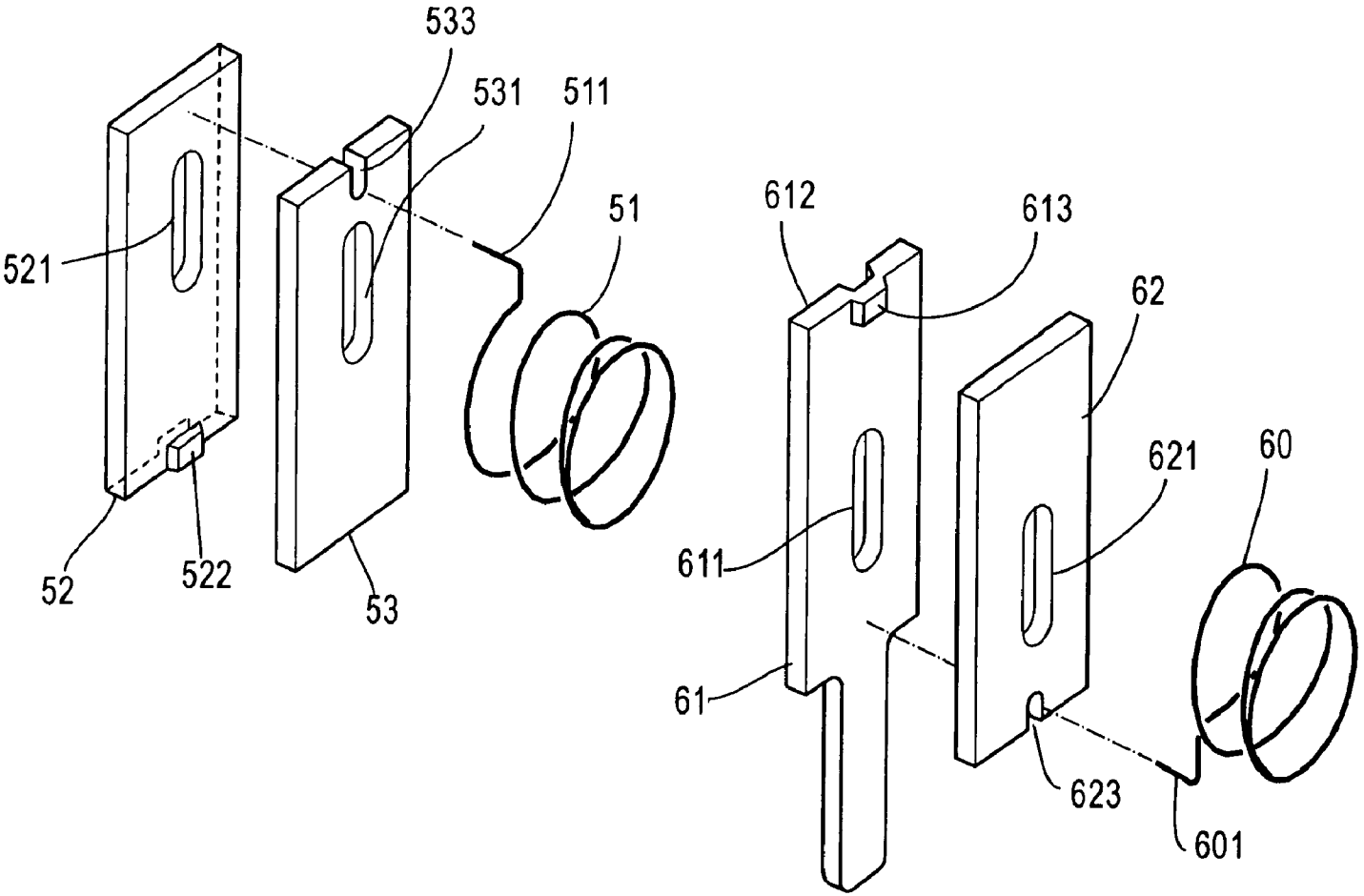
FIG. 5 is an exploded view of a second preferred embodiment of the second key plate and the fourth key plate according to the invention shown with the first and third key plates.

Referring to FIG. 5, a second preferred embodiment of the second key plate 53 and the fourth key plate 62 according to the invention is shown. The characteristics thereof are detailed below. The second key plate 53 comprises a top recess 533 instead of the upper through hole 532. The fourth key plate 62 comprises a bottom recess 623 instead of the lower through hole 622.

Figure 6:
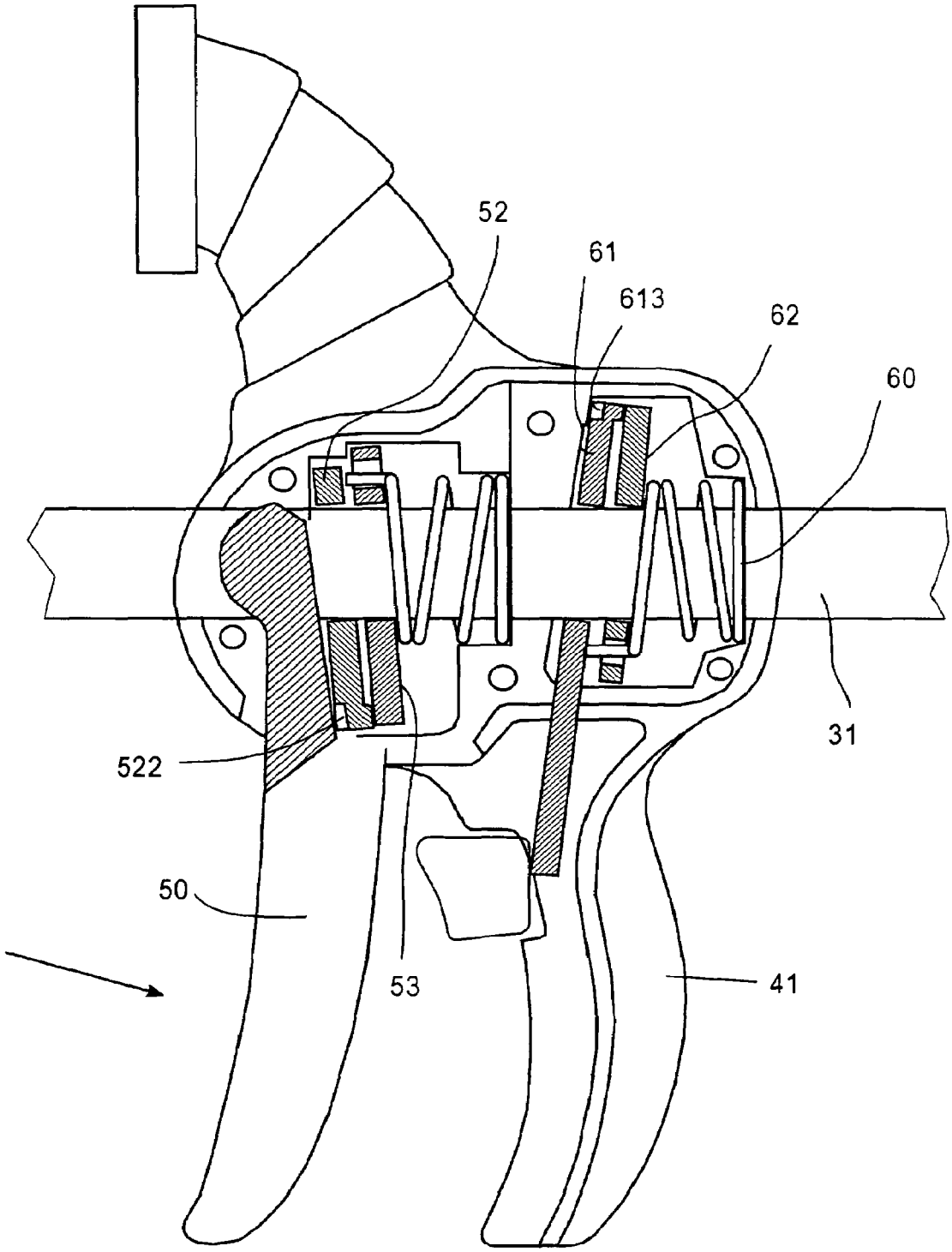
FIG. 6 is a view similar to FIG. 3 showing the incremental advance of the slide bar by repeatedly squeezing the trigger handle toward the handle grip.

Referring to FIG. 6, in a standby position, both the first key plate 52 and the second key plate 53 are oriented perpendicularly relative to a longitudinal axis of the slide bar 31, and the third key plate 61 and the fourth key plate 62 are slightly inclined relative to the longitudinal axis of the slide bar 31. Thereafter, a user may repeatedly squeeze the trigger handle 50 toward the handle grip 41 by holding with one hand to move the movable jaw of the movable jaw carrier 30 toward the fixed jaw of the fixed jaw carrier 40. As a result, the slide bar 31 advances incrementally. When squeezing the trigger handle 50 toward the handle grip 41 in one stroke, the first key plate 52 pivots counterclockwise and in turn the second key plate 53 pivots in opposition of the first spring 51 due to engagement of the pivot projection 522 with the second key plate 53. Thus, both the first key plate 52 and the second key plate 53 are slightly inclined relative to the longitudinal axis of the slide bar 31. After each stroke, a release of the trigger handle 50 returns the trigger handle 50 and both the first key plate 52 and the second key plate 53 to the standby position as a consequence of the force exerted by the first spring 51. The clamping action can be stopped when a work piece is tightly secured by the jaws.

Figure 7:
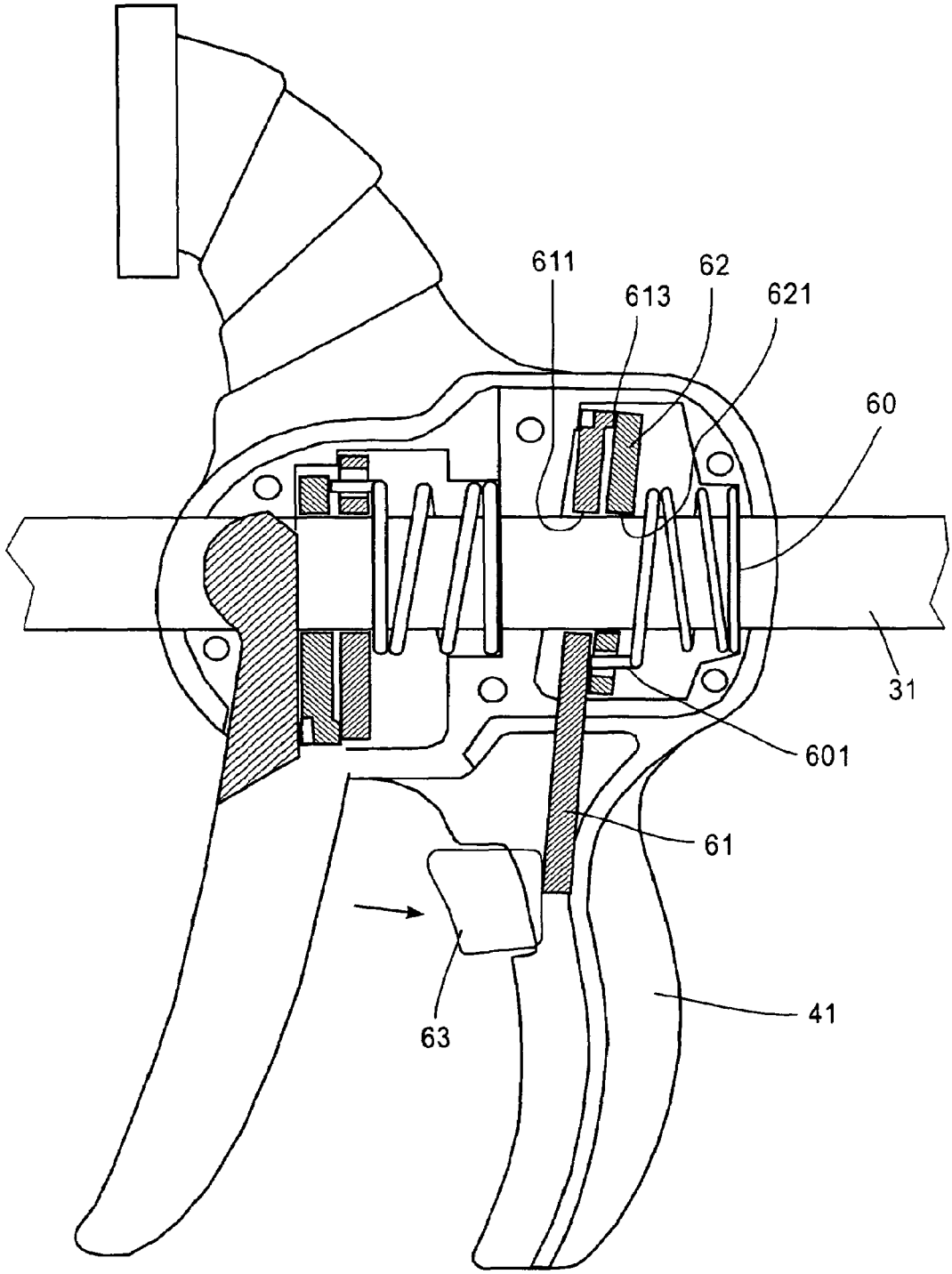
FIGS. 7 and 8 are views similar to FIG. 6 showing the unlocking of the slide bar by pressing the release button in a two-step operation respectively.
Figure 8:
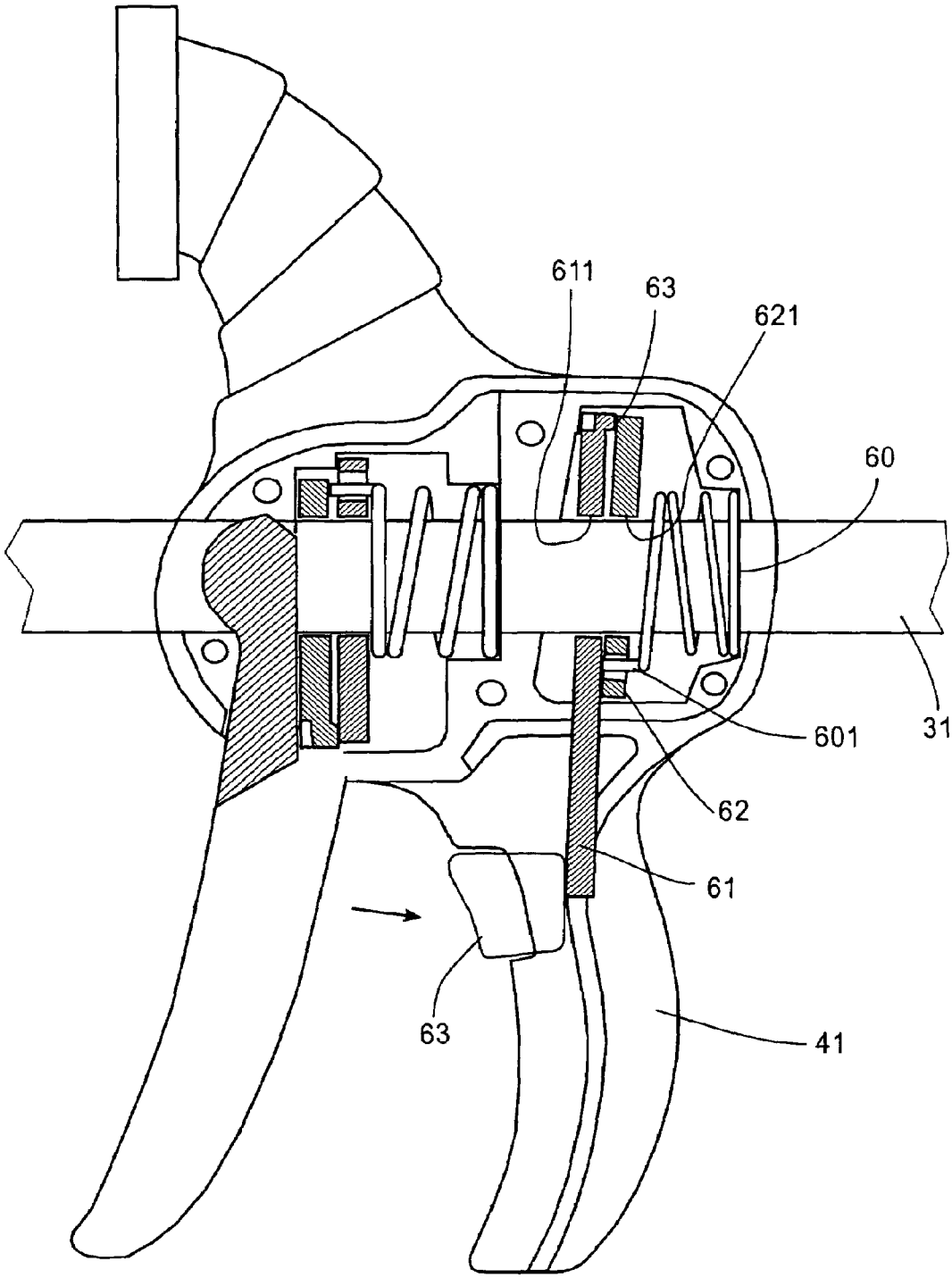

Referring to FIGS. 7 and 8, to the contrary, pressing the release button 63 against the handle grip 41 will counterclockwise pivot the protrusion 614 of the third key plate 61. Initially (i.e., a first step), only the second spring 60 is compressed by the third key plate 61 until the third key plate 61 contacts the lower portion of the fourth key plate 62. Thus, at the end of the first step, only the third key plate 61 is disposed in a position perpendicular to the longitudinal axis of the slide bar 31. Thereafter (i.e., in a second step), continuously pressing the release button 63 will further compress the second spring 60 and further counterclockwise pivot both the third key plate 61 and the fourth key plate 62 until both the third key plate 61 and the fourth key plate 62 are disposed in a position perpendicular to the longitudinal axis of the slide bar 31. After the second step, the slide bar 31 can travel freely to release the interference fit between both the third key plate 61 and the fourth key plate 62 and the slide bar 31 so as to allow the movable jaw to move away from the fixed jaw. As an end, the work piece is released.

The invention has the following advantages. Its operations are more effective due to the elimination of the intermediate pads. Further, the two-step release operation requires a minimum amount of force exerted upon the release button 63.

It is to be understood that the invention is by no means limited only to the particular constructions herein disclosed and shown in the drawings, but also comprises any modifications or equivalents within the scope of the claims.

What is claimed is:

1. A bar clamp comprising:

a housing including a front portion and a rear portion;

a movable jaw carrier having a movable jaw;

a fixed jaw carrier extended upward forward from the housing and having a fixed jaw aligned with the movable jaw;

a two-plate driving key, disposed in the front portion of the housing, composed of a forward first key plate and an intermediate second key plate with a rear first elastic member, said forward first key plate including a first slot and a lower first pivot projection projected from a rear surface, an intermediate second key plate in pivotal contact with the first pivot projection and including a second slot and an upper first passageway, and a rear first elastic member having a forward end inserted through the first passageway to engage with the rear surface of the first key plate and a remaining portion of the first elastic member urged against the rear surface of the second key plate;

a trigger handle having an inner end section engaged with a front surface of the first key plate;

a two-plate locking key, disposed in the rear portion of the housing, composed of a forward third key plate and an intermediate fourth key plate and a rear second elastic member, said forward third key plate including a third slot, a protrusion extended downward from a bottom, and an upper second pivot projection projected from a rear surface, an intermediate fourth key plate in pivotal contact with the second pivot projection and including a fourth slot and a lower second passageway, and a rear second elastic member having a forward end inserted through the second passageway to engage with the rear surface of the third key plate and a remaining portion of the second elastic member urged against the rear surface of the fourth key plate;

a handle grip extended downward from a bottom of the housing;

a release button projected from a front surface of the handle grip and engaged with a lower portion of the protrusion; and a longitudinal slide bar disposed through the second elastic member, the fourth and third slots, the first elastic member, the second and first slots, and the movable jaw carrier, wherein in a standby position, the first and second key plates are oriented substantially perpendicularly to a longitudinal axis of the slide bar, and the third and fourth key plates are substantially inclined relative to the longitudinal axis of the slide bar;

whereby squeezing the trigger handle toward the handle grip will counterclockwise pivot the first and second key plates in opposition of the first elastic member to dispose the first and second key plates at an inclined angle relative to the longitudinal axis of the slide bar with the movable jaw moved toward the fixed jaw by a predetermined distance;

whereby releasing of the trigger handle will return the trigger handle and the driving key to the standby position;

whereby pressing the release button against the handle grip will counterclockwise pivot the protrusion to compress the second elastic member until the third key plate contacts the fourth key plate and the third key plate is disposed perpendicularly to the longitudinal axis of the slide bar; and whereby further pressing the release button will counterclockwise pivot the third and fourth key plates until the third and fourth key plates are disposed perpendicularly to the longitudinal axis of the slide bar.

2. The bar clamp of claim 1, wherein the first passageway is either a recess or a through hole.

3. The bar clamp of claim 1, wherein the second passageway is either a recess or a through hole.

4. The bar clamp of claim 1, wherein at least one of said first elastic member and said second elastic member is a spring.

5. The bar clamp of claim 1, wherein at least one of said first pivot projection and said second pivot projection are continuous with the forward first key plate or the forward third key plate, respectively.

6. The bar clamp of claim 5, wherein at least one of said first elastic member and said second elastic member is a spring.

7. A bar clamp comprising:

a housing including a front portion and a rear portion;

a movable jaw carrier having a movable jaw;

a fixed jaw carrier extended upward forward from the housing and having a fixed jaw aligned with the movable jaw;

a two-plate driving key, disposed in the front portion of the housing, composed of a forward first key plate and an intermediate second key plate with a rear first spring, said forward first key plate including a first slot and a lower first pivot projection projected from a rear surface, an intermediate second key plate in pivotal contact with the first pivot projection and including a second slot and an upper first passageway, and a rear first spring having a forward end inserted through the first passageway to engage with the rear surface of the first key plate and a remaining portion of the first spring urged against the rear surface of the second key plate;

a trigger handle having an inner end section engaged with a front surface of the first key plate;

a two-plate locking key, disposed in the rear portion of the housing, composed of a forward third key plate and an intermediate fourth key plate and a rear second spring, said forward third key plate including a third slot, a protrusion extended downward from a bottom, and an upper second pivot projection projected from a rear surface, an intermediate fourth key plate in pivotal contact with the second pivot projection and including a fourth slot and a lower second passageway, and a rear second spring having a forward end inserted through the second passageway to engage with the rear surface of the third key plate and a remaining portion of the second spring urged against the rear surface of the fourth key plate;

a handle grip extended downward from a bottom of the housing;

a spring-biased release button projected from a front surface of the handle grip and engaged with a lower portion of the protrusion; and a longitudinal slide bar disposed through the second spring, the fourth and third slots, the first spring, the second and first slots, and the movable jaw carrier, wherein in a standby position, the first and second key plates are oriented substantially perpendicularly to a longitudinal axis of the slide bar, and the third and fourth key plates are substantially inclined relative to the longitudinal axis of the slide bar;

whereby squeezing the trigger handle toward the handle grip will counterclockwise pivot the first and second key plates in opposition of the first spring to dispose the first and second key plates at an inclined angle relative to the longitudinal axis of the slide bar with the movable jaw moved toward the fixed jaw by a predetermined distance;

whereby releasing of the trigger handle will return the trigger handle and the driving key to the standby position;

whereby pressing the release button against the handle grip will counterclockwise pivot the protrusion to compress the second spring until the third key plate contacts the fourth key plate and the third key plate is disposed perpendicularly to the longitudinal axis of the slide bar; and whereby further pressing the release button will counterclockwise pivot the third and fourth key plates until the third and fourth key plates are disposed perpendicularly to the longitudinal axis of the slide bar.

8. The bar clamp of claim 7, wherein the first passageway is either a recess or a through hole.

9. The bar clamp of claim 7, wherein the second passageway is either a recess or a through hole.

10. The bar clamp of claim 7, wherein at least one of said first pivot projection and said second pivot projection are continuous with the forward first key plate or the forward third key plate, respectively.

* * * * *